US007419069B2

(12) United States Patent
Naesje

(10) Patent No.: US 7,419,069 B2
(45) Date of Patent: Sep. 2, 2008

(54) VALVE FOR A DRINKING RECEPTACLE

(75) Inventor: Kjetil Naesje, Sandnes (NO)

(73) Assignee: SmartSeal AS (NO)

( * ) Notice: Subject to any disclaimer, the term of this patent is extended or adjusted under 35 U.S.C. 154(b) by 176 days.

(21) Appl. No.: 10/572,111

(22) PCT Filed: Sep. 16, 2004

(86) PCT No.: PCT/NO2004/000274

§ 371 (c)(1),
(2), (4) Date: Mar. 16, 2006

(87) PCT Pub. No.: WO2005/026012

PCT Pub. Date: Mar. 24, 2005

(65) Prior Publication Data

US 2007/0051723 A1 Mar. 8, 2007

(30) Foreign Application Priority Data

Sep. 16, 2003 (NO) ..... 200334132

(51) Int. Cl.
*A47G 19/22* (2006.01)

(52) U.S. Cl. ..... 220/714; 220/203.11; 220/717; 215/387; 215/11.4; 137/455

(58) Field of Classification Search ..... 220/714, 220/203.11, 717, 203.01, 203.14; 215/11.4, 215/387, 260; 137/455
See application file for complete search history.

(56) References Cited

U.S. PATENT DOCUMENTS 2,442,656 A * 6/1948 Less ..... 215/11.4
2,492,225 A * 12/1949 Kester ..... 220/203.14
2,584,359 A * 2/1952 Miles ..... 215/11.4
2,628,004 A * 2/1953 Schlicksupp ..... 222/493
2,834,496 A * 5/1958 Boston et al. ..... 215/11.1
2,913,749 A * 11/1959 Ayres ..... 401/196
4,616,768 A 10/1986 Flier
4,739,906 A * 4/1988 LoTurco ..... 222/212
5,238,153 A * 8/1993 Castillo et al. ..... 222/189.09
5,462,194 A * 10/1995 Barnwell ..... 220/709
5,989,469 A 11/1999 Dirr
6,176,380 B1 * 1/2001 Glories et al. ..... 215/11.1
6,290,090 B1 9/2001 Essebaggers
6,305,570 B1 * 10/2001 Atkin et al. ..... 220/714
6,629,624 B2 * 10/2003 Stillinger et al. ..... 220/714
6,745,915 B2 * 6/2004 Rees ..... 220/714
6,758,364 B1 * 7/2004 Rohrig ..... 220/714

(Continued)

FOREIGN PATENT DOCUMENTS

| | | |
|---|---|---|
| EP | 1 051 094 | 6/2003 |
| NO | 315182 | 7/2003 |
| WO | WO 2004039690 | 5/2004 |

*Primary Examiner*—Anthony Stashick
*Assistant Examiner*—Christopher B McKinley
(74) *Attorney, Agent, or Firm*—Andrus, Sceales, Starke & Sawall, LLP

(57) ABSTRACT

This invention concerns a valve for an underpressure-activated outflow mechanism for a drinking receptacle (2). The valve includes a valve head (34) and a valve seat (44), in which the valve seat (44) is arranged in force-transmitting connection with a membrane (1), whereas the valve head (34) is fixed to the remaining structure via at least one stay (36).

21 Claims, 11 Drawing Sheets

U.S. PATENT DOCUMENTS 6,938,794 B2 * 9/2005 Elder ..... 220/714
7,070,065 B2 * 7/2006 Wong ..... 220/714
2002/0121525 A1 9/2002 Stillinger et al.
2004/0144792 A1 7/2004 Naesje
2006/0043096 A1 * 3/2006 Naesje ..... 220/714

* cited by examiner

VALVE FOR A DRINKING RECEPTACLE

CROSS-REFERENCE TO RELATED APPLICATIONS

This application is the U.S. national stage application of International Application PCT/NO2004/000274, filed Sep. 16, 2004, which International Application was published on Mar. 24, 2005, as International Publication No. WO 2005/026012 A1 in the English language. The International Application claims priority of Norwegian Patent Application 200334132, filed Sep. 16, 2003.

BACKGROUND OF THE INVENTION

This invention concerns an underpressure-activated valve device for a drinking receptacle. The valve includes a valve head, a valve seat and a flexible membrane. The valve seat is in force-transmitting connection with the flexible membrane, whereas the valve head is fixed to an associated support structure. Particularly, the invention is directed towards a valve design suitable for mould casting and mass production.

The patent literature discloses several devices that utilize underpressure for activating a valve for a drinking receptacle, for example as shown in U.S. Pat. No. 6,290,090 and in Norwegian patent no. 315182. Common to prior art in this area is that the valve seat is fixed to an associated structure, and that only the sealing surface of the valve head can be moved or change shape during activation of the valve. By making the valve seat moveable, however, it is possible to obviate the need for the valve head requiring horizontal sealing surfaces that must be pulled out of the casting mould after moulding, which may inflict damage to such a sealing surface. The sealing surface may also become damaged during assembly, inasmuch as it becomes strongly deformed when forced through a valve opening. Having to inspect the sealing surface by means of known inspection methods provides both an increase in cost and complexity.

SUMMARY OF THE INVENTION

The object of the invention is to remedy said disadvantages of prior art.

First and foremost, the present invention seeks to improve aspects of manufacturing and cost of the prior art.

It is also an object of the invention to provide a valve design which is simple to manufacture and capable of tolerating a relatively high pressure.

The object is achieved in accordance with the features disclosed in the following description of the invention and in the subsequent claims.

The present valve device is intended for use on a drinking receptacle having an internal pressure P3. The valve is provided in an enclosure, a downstream end thereof being provided with a drinking opening, and an upstream end thereof being open. In position of use, the upstream end of the enclosure is attached around an opening in the drinking receptacle, whereby the valve may open and close to liquid outflow from the drinking receptacle via said drinking opening, which is provided downstream of the valve. The valve generally comprises:

- a flexible membrane body provided with an attachment end fixedly connected to the enclosure when in position of use, and a free manoeuvre end pressure-sealingly and movably connected to the enclosure;
- a valve head; and

- a valve seat against which the valve head seals when the valve is inactive and in its position of rest.

The enclosure also contains:

- a pressure balancing chamber communicating with the ambient pressure P1 of the enclosure and one side of the membrane body; and
- a suction chamber communicating with said downstream drinking opening and the other side of the membrane body. The valve is arranged to open to said liquid outflow when the suction chamber, via said downstream drinking opening, is supplied an underpressure P2 which is less than said ambient pressure P1 by a predetermined value. Thereby, the membrane body is exposed to a pressure difference (P1-P2) that activates and moves the membrane body with a valve-opening is force.

The novel features of the present valve device comprise:

- that the valve head is fixedly and by-passably connected to the enclosure;
- that the valve seat is connected to the manoeuvre end of the membrane body;
- that the valve seat is provided upstream of the valve head; and that the valve seat is pressure-sealingly and movably connected to the enclosure. Thereby, the valve seat may be moved away from the valve head and open the valve to liquid outflow when the suction chamber is supplied said underpressure P2.

Normally, the ambient pressure P1 consists of atmospheric pressure. The internal pressure P3 of the drinking receptacle, however, may be equal to or higher than the ambient pressure P1 when the valve is inactive and closed, whereas the pressure P3 may in fact be less than the ambient pressure P1 when the valve is open and outflow of liquid is taking place.

For example, said drinking receptacle may be comprised of a bottle, a carton, a drinking bag, a cup, a feeding bottle, etc. The liquid in the drinking receptacle may be any liquid article of food, including a pressurized drink, a warm drink, liquid food, ice cream, etc.

In principle, all known types of membranes may be used for the present membrane body; for example flat, circular and radially suspended membranes, or membranes having a conical, three-dimensional shape. The membranes may have a symmetrical shape or an asymmetrical shape. They may also consist of several materials, for example combinations of rigid ribs or portions transmitting force, and also soft plastics allowing radial compression of the membrane body.

Preferably, both the membrane body and the valve seat should consist of a flexible and soft material, preferably the same material. However, the valve head and its fixed connection link to the enclosure should consist of a stiffer material.

By means of the present valve design, the valve seat is force-transmittingly connected to the membrane body. When for example a user sucks an underpressure P2 in said suction chamber and pressure-influences said other side of the membrane body, the membrane body is moved and/or deformed and hence transmits a substantially axial valve-opening force to the valve seat. Due to valve head being fixedly connected to the enclosure, the valve seat is thus moved away from a sealing engagement with the valve head and opens the valve to outflow.

Said membrane body may have an axial extension and thus may form a sleeve-like body. Advantageously, the sleeve-like body may have a tubular, conical or approximately conical shape. When influenced by pressure, the membrane body thus may move radially and reduce the axial extension thereof. This membrane shape produce a large valve-opening force during incipient opening of the valve and may be used to advantage when a relatively high valve-closing pressure P3 is present in the drinking receptacle. Thereby, a relatively large valve-opening force may be achieved upon supply of a moderate underpressure P2 in said suction amber.

In one embodiment, the attachment end of the membrane body may be connected to the enclosure at or near the upstream end thereof, whereas the manoeuvre end of the membrane body may be connected to the enclosure at or near the downstream end thereof.

Thus, the upstream side of the valve seat may be flexibly connected to an outflow opening in a partition provided between the attachment end and the opening in the drinking receptacle. Thereby, said suction chamber is provided between the partition and the membrane body, whereas said pressure balancing chamber is provided between the membrane body and the enclosure. Moreover, the valve seat is provided with at least one connection channel connecting the suction chamber with the drinking opening, thereby allowing said underpressure P2 to be supplied to the suction chamber for activating and opening the valve.

The upstream side of the valve seat may also be provided with a flexible ring gasket arranged so as to engage pressure-sealingly around said outflow opening in the partition. For example, the outflow opening may be provided in a free end of a tubular outflow channel, which projects out from the partition and forms a part thereof. As an alternative, the upstream side of the valve seat may be provided with a flexible sleeve, for example a soft and/or bellows-shaped sleeve, which is connected to said outflow opening in the partition. The sleeve may form a separate part connected to the valve seat, or the sleeve may be integrated, for example moulded, together with the valve seat. Furthermore, the upstream end of the sleeve may be connected to a tubular outflow channel, which projects out from the partition and forms a part thereof.

The valve seat may be pressure-sealingly and movably connected to the enclosure via a flexible sealing collar provided on the outside of the valve seat.

In view of mass-producing the membrane body through moulding, it is also favourable for the membrane body to have a spread-out Y-shape when moulded and removed from a corresponding casting mould. This Y-shaped membrane body is easy to remove from the casting mould, and without inflicting any damage thereto. Thus, the membrane body will have this Y-shape immediately after removal from the casting mould, after which it can be deflected and folded down into its normal shape for subsequent assembly and use with other associated components.

In another embodiment, the attachment end of the membrane body may be connected to the enclosure at or near the downstream end thereof, whereas the manoeuvre end of the membrane body may be connected to the enclosure at or near the upstream end thereof.

Thus, the upstream side of the valve seat may be pressure-sealingly and movably connected to the enclosure via a flexible sealing collar provided on the outside of the valve seat and projecting out therefrom. Thus, said pressure balancing chamber is provided between the sealing collar, the membrane body and the enclosure, whereas the suction chamber is provided between the membrane body and said drinking opening in the enclosure. Moreover, the valve seat is provided with at least one connection channel connecting the suction chamber with the drinking opening, thereby allowing said underpressure P2 to be supplied to the suction chamber for activating and opening the valve. Furthermore, the flexible sealing collar may be connected to a sealing surface in the form of an internal shoulder in the enclosure.

Yet further, the attachment end of the membrane body may be releasably connected to the enclosure. The attachment end and the enclosure may be connected via a quick release coupling, for example a snap coupling or a threaded connection.

The enclosure may also be provided with an internal collar defining said drinking opening, in which the internal collar is provided with a first coupling element of the quick release coupling, whereas said attachment end is provided with a cooperating second coupling element of the quick release coupling.

In general, the enclosure may be provided with at least one vent, for example a hole, into said pressure balancing chamber.

Besides, the valve head may be connected to the enclosure via at least one stay.

Moreover, the valve head and/or the valve seat may be provided with, or be arranged as, a guiding device that centres the valve head in the valve seat during closing of the valve.

A particularly advantageous feature of the present valve device is that the valve-closing pressure, which the movable valve seat exerts against the valve head when in position of use, will increase when subjected to an increasing internal pressure P3 in the drinking receptacle. Thereby the valve will not be able to open when an overpressure P3 is present in the receptacle, or in response to the receptacle being pressed together. This prevents unintended outflow and spill from the drinking receptacle; as opposed to that of many known valves for drinking receptacles.

The present valve device and enclosure may be equipped, as needed, with a protective top cover and/or other special technical adaptations of suitable types. This especially concerns the choice of methods and devices for connecting the valve device and/or the enclosure to the drinking receptacle. This also concerns the choice of design of flange-like seals, including said ring gasket and sealing collars, and also quick release couplings, including snap couplings and threaded connections, between parts in the valve device and/or the enclosure. These may be adapted for use on all types of drinking receptacles. If the device is to be adapted for easy cleaning and/or reuse, for example threaded connections may be used instead of snap couplings.

In the following, several non-limiting examples of preferred embodiments of the present valve device are described, in which these are shown in vertical sections in the accompanying drawings, in which:

BRIEF DESCRIPTION OF THE DRAWINGS

FIGS. 4*a*-4*c* show a fourth embodiment of a valve device according to the invention, in which FIGS. 4*a*-4*c* show individual components of the valve device prior to their assembly, whereas

DETAILED DESCRIPTION OF THE DRAWINGS

Figure 1A:
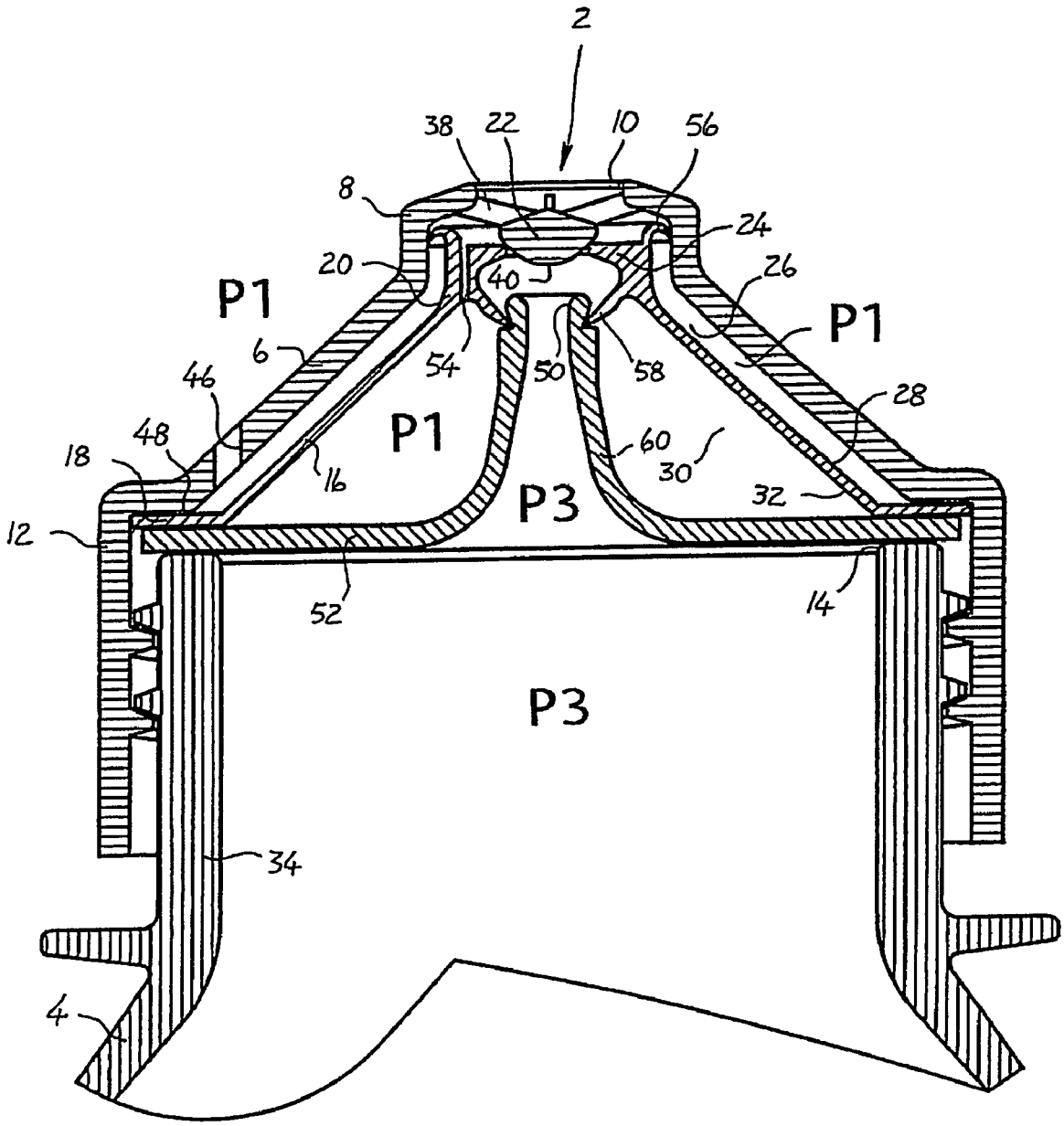
FIGS. 1*a*-1*b* show a first embodiment of a valve device according to the invention provided within an enclosure in the form of a screw cap connected to a bottle, the valve being shown in a closed and an open position, respectively.

The figures are schematic and may therefore be somewhat distorted with respect to sizes and relative positions of details shown in the figures. Similar reference numerals are substantially used for similar or corresponding details in the various examples of embodiments of the invention.

All of the figures show a device of a valve 2 for a drinking receptacle 4 having an internal pressure P3. The valve 2 is provided in an enclosure 6, a downstream end 8 thereof being provided with a drinking opening 10, and an upstream end 12 thereof being open and attached around an opening 14 in the drinking receptacle 4 when in position of use. Thereby, the valve 2 may open and close to liquid outflow (not shown) from the drinking receptacle 4 via said drinking opening 10, which is provided downstream of the valve 2.

In general, the valve 2 according to the invention comprises:

- a flexible membrane body 16 provided with an attachment end 18 fixedly connected to the enclosure 6 when in position of use, and also a free manoeuvre end 20 pressure-sealingly and movably connected to the enclosure 6;
- a valve head 22; and
- a valve seat 24 against which the valve head 22 seals when the valve 2 is inactive and in its position of rest.

The enclosure 6 also contains:

- a pressure balancing chamber 26 communicating with an ambient pressure P1 of the enclosure 6 and one side 28 of the membrane body 16; and
- a suction chamber 30 communicating with said downstream drinking opening 10 and the other side 32 of the membrane body 16. The valve 2 is arranged so as to open to said liquid outflow when the suction chamber 30, via the downstream drinking opening 10, is supplied an underpressure P2 which is less than said ambient pressure P1 by a predetermined value. Thereby, the membrane body 16 is exposed to a pressure difference (P1-P2) that activates and moves the membrane body 16 with a valve-opening force.

The novel features of the valve 2 comprise:

- that the valve head 22 is fixedly and by-passably connected to the enclosure 6;
- that the valve seat 24 is connected to the manoeuvre end 20 of the membrane body 16;
- that the valve seat (24) is provided upstream of the valve head 22; and
- that the valve seat 24 is pressure-sealingly and movably connected to the enclosure 6. Thereby, the valve seat 24 may be moved away from the valve head 22 and open the valve 2 to liquid outflow when the suction chamber 30 is supplied said underpressure P2.

In FIGS. 1*a*-1*b* and 2*a*-2*b*, the drinking receptacle 4 consists of a bottle with a threaded drinking spout 34 defining said opening in the bottle 4, whereas the enclosure 6 consists of an internally threaded screw cap releasably connected to the drinking spout 34.

Figure 3A:
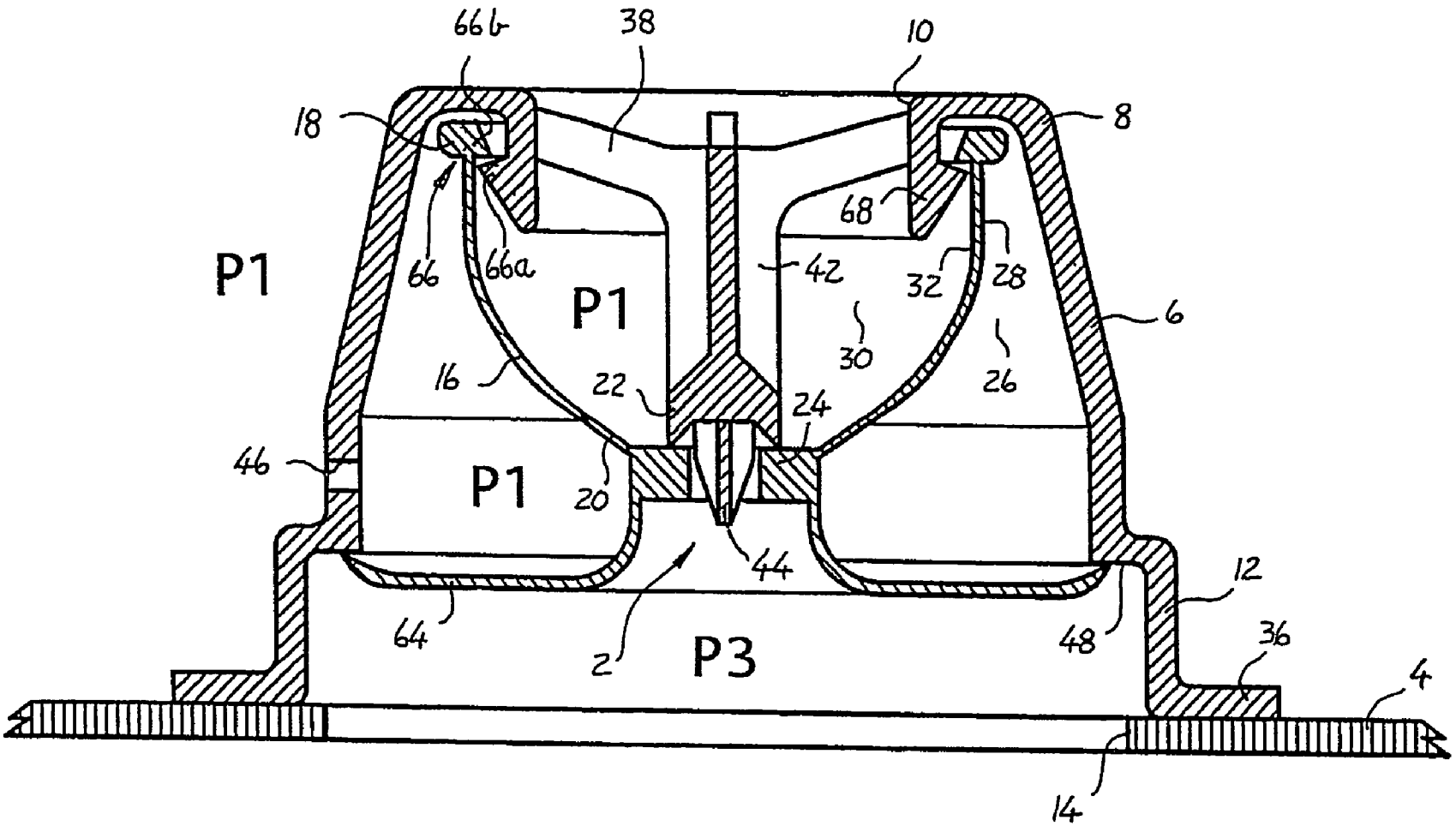
FIGS. 3*a*-3*c* show a third embodiment of a valve device according to the invention provided within an enclosure connected to a drinking receptacle, the valve being shown in a closed, an open and also an open and venting position, respectively.
Figure 3B:
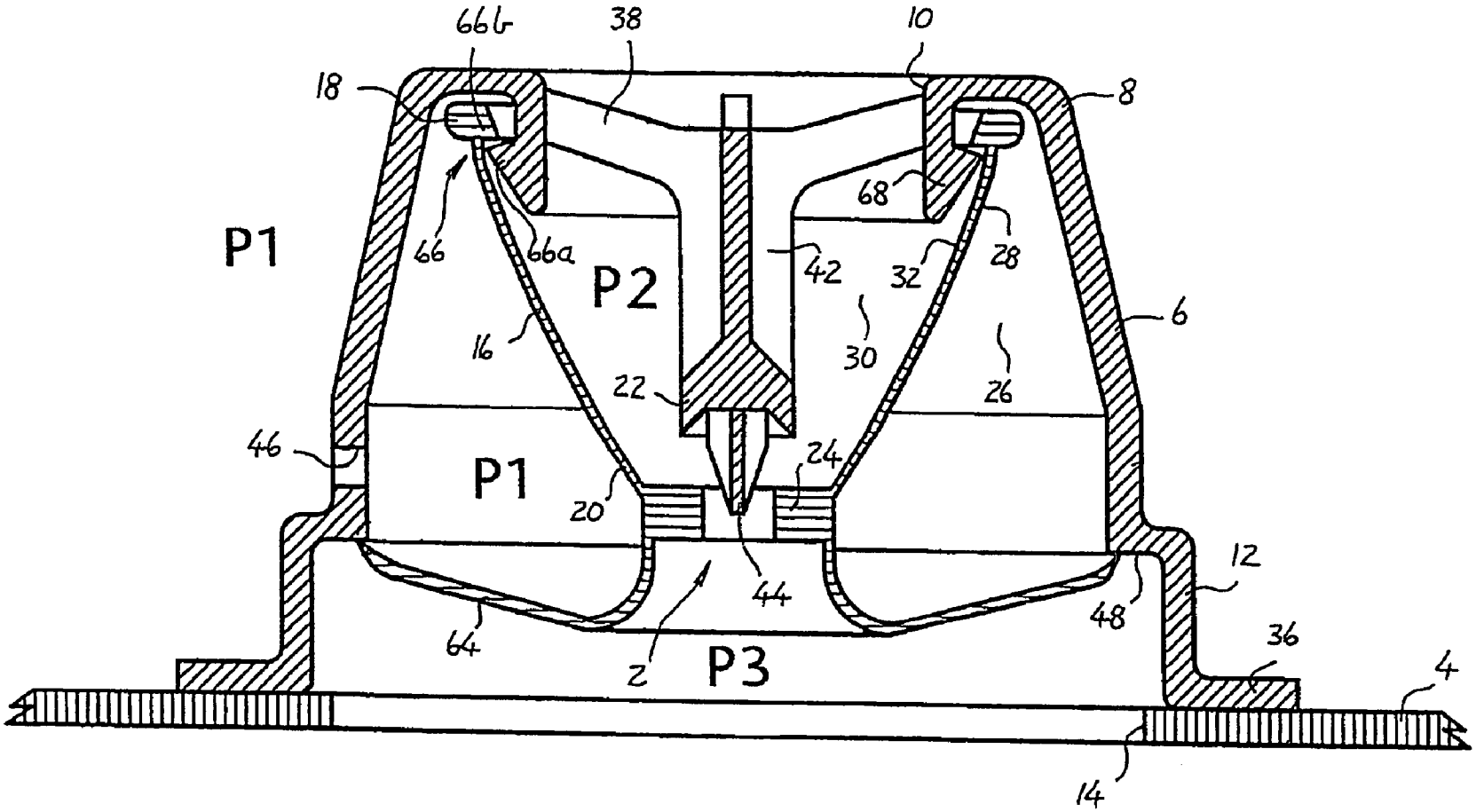
Figure 3C:
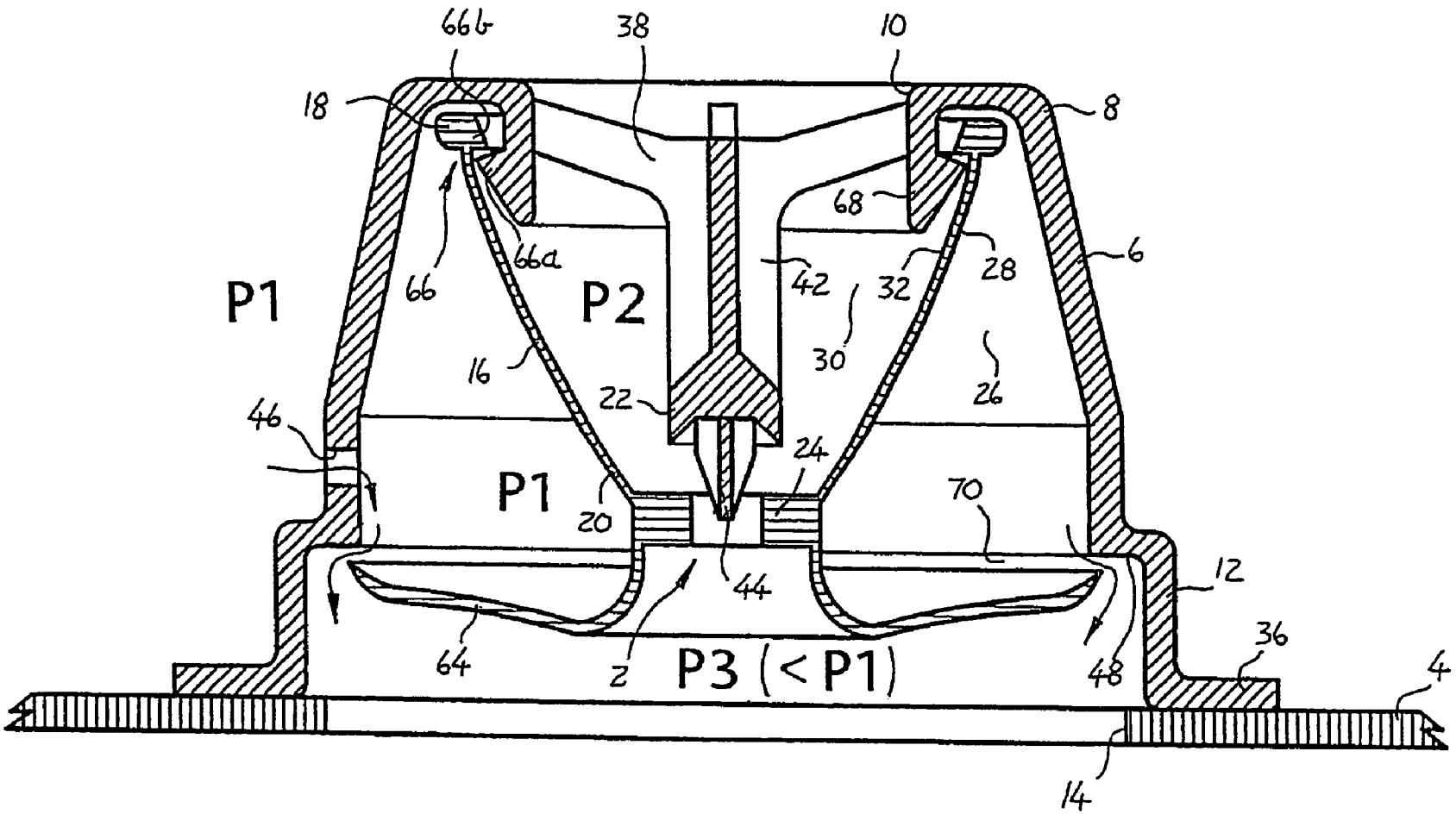

FIGS. 3*a*-3*c*, however, show only a portion of a wall of a drinking receptacle 4, for example a drinking carton, with an opening 14 for liquid outflow. This embodiment example shows another type of enclosure 6 provided with an external flange 36 attached on the outside of the drinking receptacle 4 and around its opening 14.

In all of the figures, the membrane body 16 has an axial extension and forms a sleeve-like body with a conical shape (cf. FIG. 1*a*-2*b*) or approximately conical shape (cf. FIG. 3*a*-3*b*) when the body is in its position of rest. Moreover, the valve head 22 is connected to the enclosure 6 via at least one connection stay 38. In FIGS. 1*a*-2*b*, the valve head 22 is provided with an upstream dome-shaped portion 40, which constitutes a guiding device that centres the valve head 22 in a complementarily-shaped valve seat 24 during closing of the valve 2 (cf. FIGS. 1*a* and 2*a*). In FIGS. 3*a*-3*c*, however, the valve head 22 comprises an axial stay 42, one end thereof being connected to said connection stay 38, and the other end thereof being provided with a guide peg 44, which constitutes a guiding device that centres the valve head 22 against the valve seat 24 during closing of the valve 2 (cf. FIG. 3*a*). Besides, all figures show that the enclosure 6 is provided with at least one vent 46 into said pressure balancing chamber 26.

In FIGS. 1*a*-1*b* and 2*a*-2*b*, the attachment end 18 of the membrane body 16 is connected to the screw cap 6 and the bottle 4 near the upstream end 12 of the screw cap 6, and between the drinking spout 34 and a shoulder 48 formed within the screw cap 6. The manoeuvre end 20 of the membrane body 16, however, is connected to the enclosure 6 at the downstream end 8 of the screw cap 6. The upstream side of the valve seat 24 is flexibly connected to an outflow opening 50 in a partition 52 provided between the attachment end 18 and the opening 14 in the bottle 4. Thereby, said suction chamber 30 is provided between the partition 52 and the membrane body 16, whereas said pressure balancing chamber 26 is provided between the membrane body 16 and the screw cap 6. The valve seat 24 is provided with at least one connection channel 54 connecting the suction chamber 30 with the drinking opening 10. Furthermore, the valve seat 24 is pressure-sealingly and movably connected to the screw cap 6 via a flexible sealing collar 56 provided on the outside of the valve seat 24.

Figure 1B:
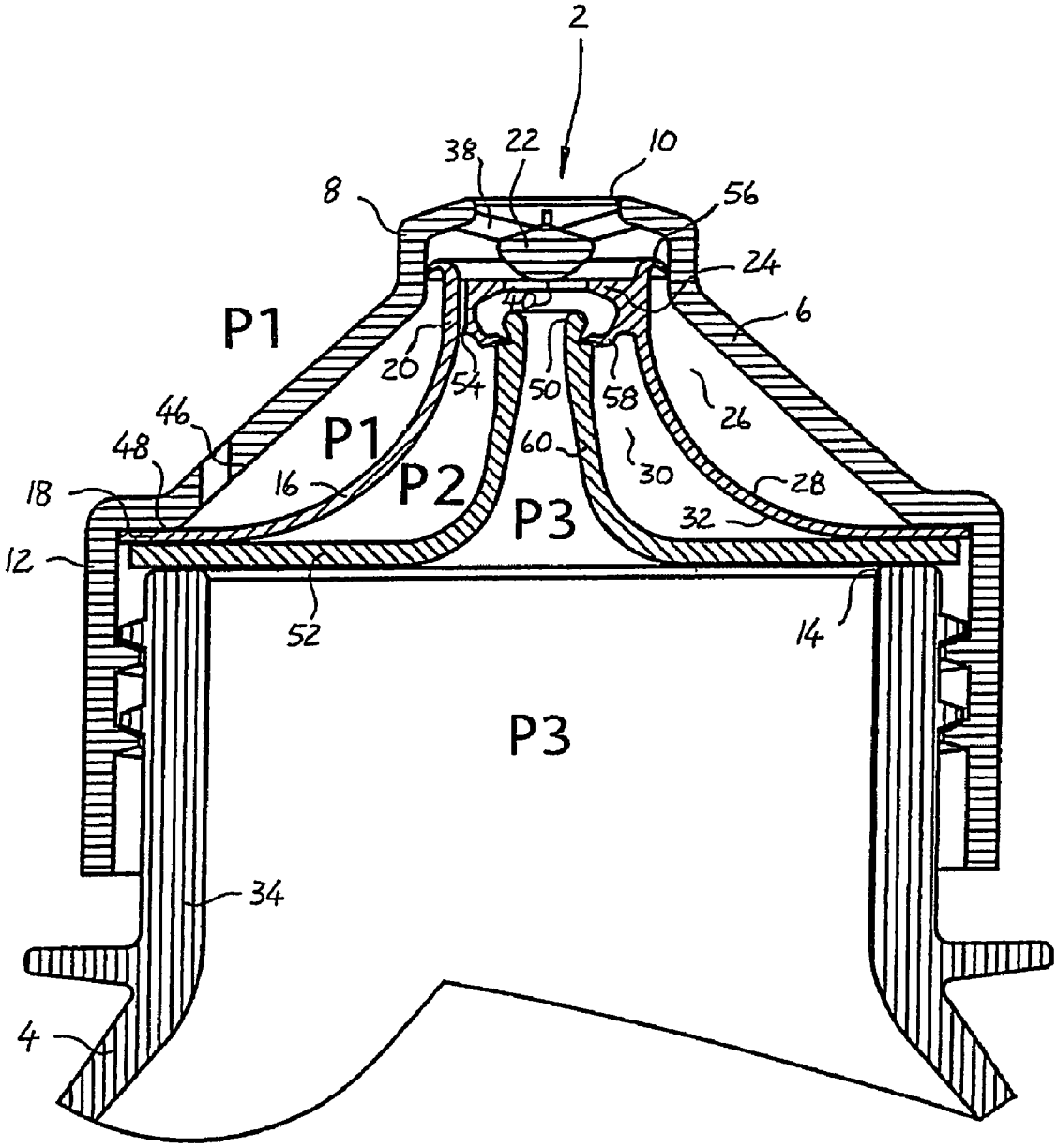

In FIGS. 1*a*-1*b*, the upstream side of the valve seat 24 is also provided with a flexible ring gasket 58 arranged so as to engage pressure-sealingly around said outflow opening 50 in the partition 52. In this example, the outflow opening 50 is provided in a free end of a tubular outflow channel 60, which projects out from the partition 52 and forms a part thereof.

Figure 2A:
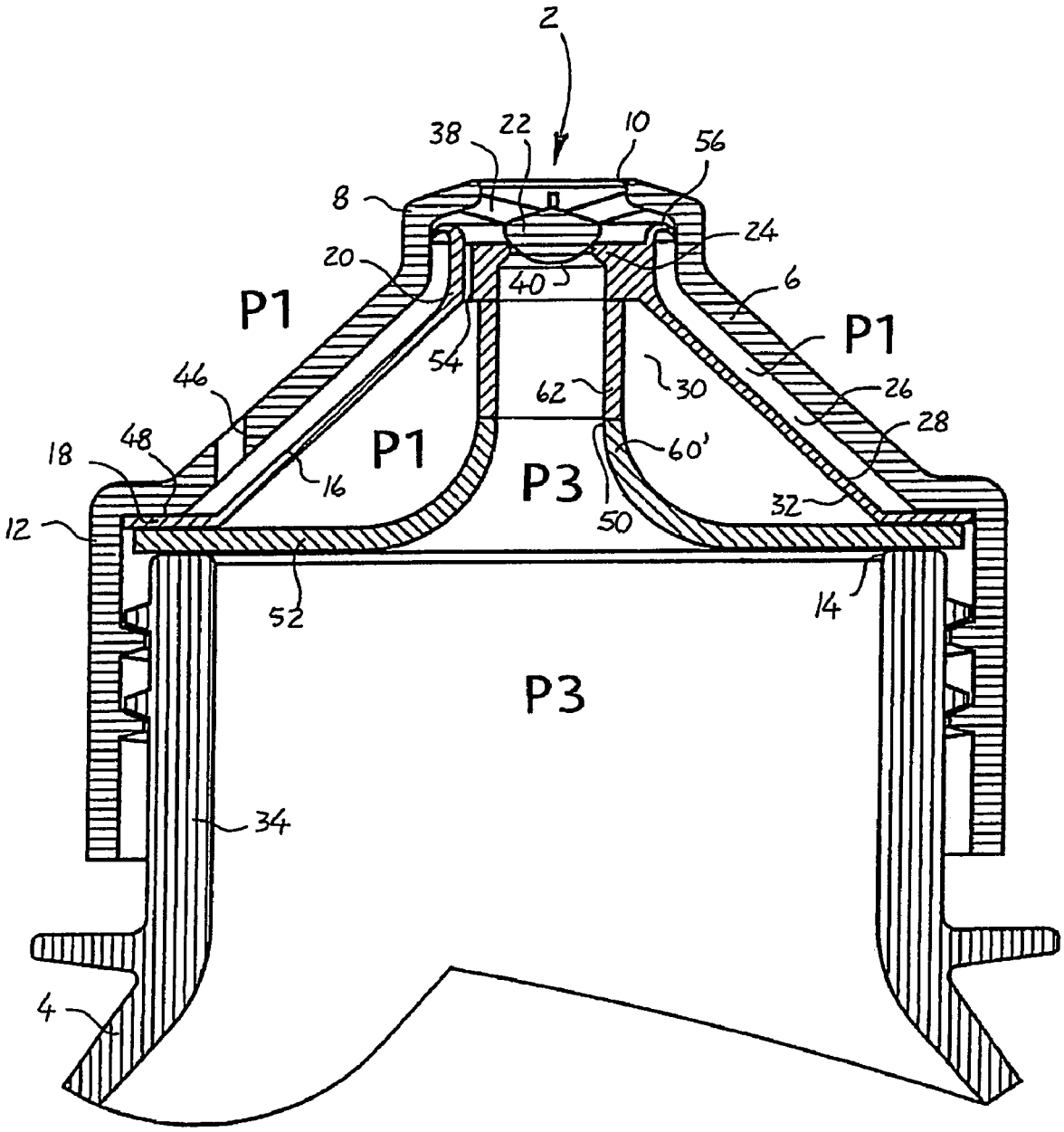
FIGS. 2*a*-2*b* show a second embodiment of a valve device according to the invention provided within an enclosure in the form of a screw cap connected to a bottle, the valve being shown in a closed and an open position, respectively.
Figure 2B:
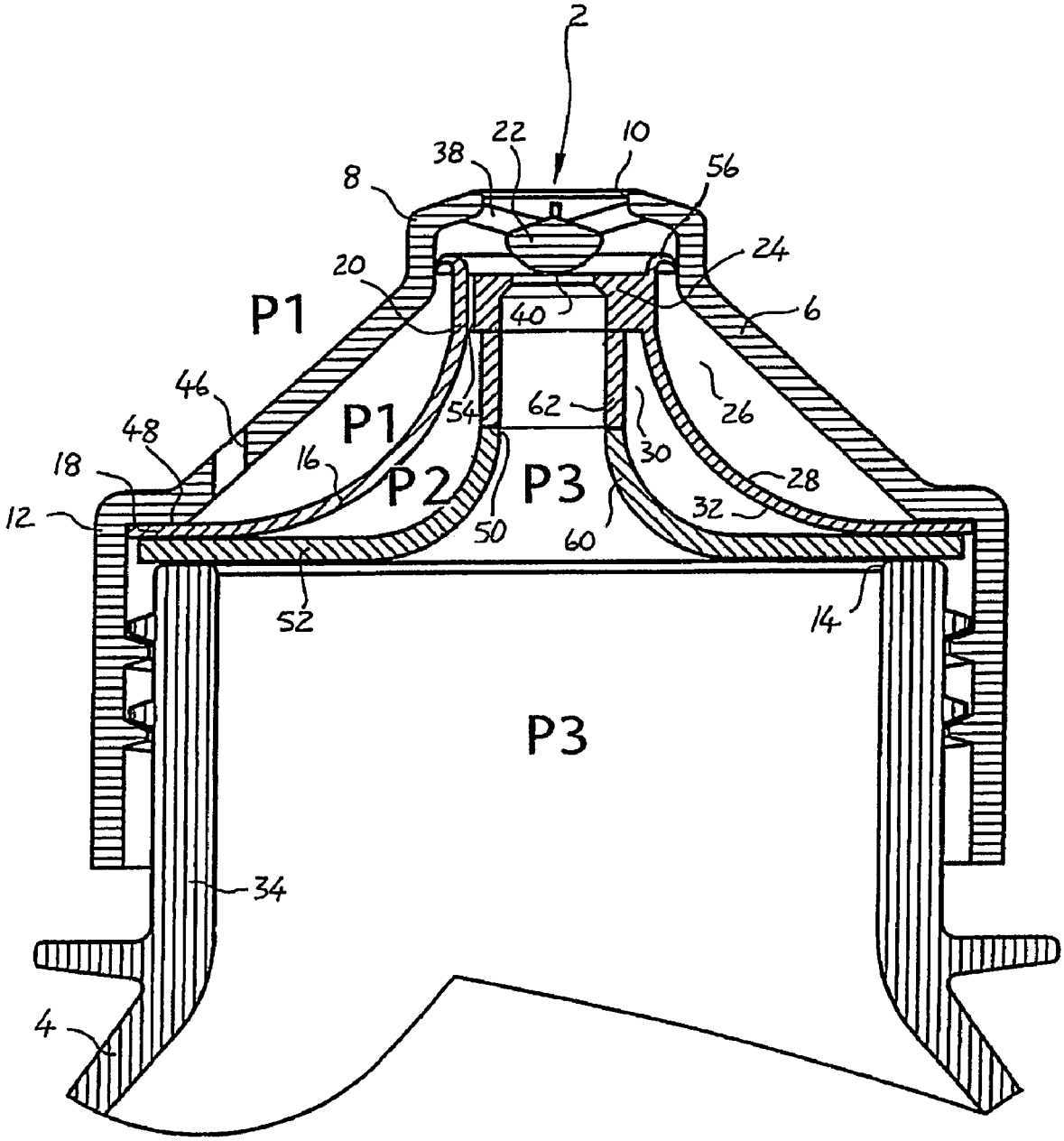

In FIGS. 2*a*-2*b*, the upstream side of the valve seat 24 is provided with a relatively soft sleeve 62, which is connected to a somewhat differently shaped outflow opening 50 in the partition 52. In this example, the upstream end of the sleeve 62 is connected to an extruded and also somewhat shorter tubular outflow channel 60', which projects out from the partition 52 and forms a part thereof. Upon activation and movement of the membrane body 16, the sleeve 62 will be compressed temporarily and shortened axially (cf. FIG. 2*b*).

In FIGS. 3*a*-3*c*, however, the attachment end 18 of the membrane body 16 is connected to the enclosure 6 and the drinking receptacle at the downstream end 8 of the enclosure 6, whereas the manoeuvre end 20 of the membrane body 16 is connected to the enclosure 6 near the upstream end 12 of the enclosure 6. Moreover, the upstream side of the valve seat 24 is pressure-sealingly and movably connected to the enclosure 6 via a flexible sealing collar 64 provided on the outside of the valve seat 24 and projecting out therefrom. Thus, said pressure balancing chamber 26 is provided between the sealing collar 64, the membrane body 16 and the enclosure 6, whereas said suction chamber 30 is provided between the membrane body 16 and said drinking opening 10 in the enclosure 6. The flexible sealing collar 64 is connected to a sealing surface in the form of an internal shoulder 48 in the enclosure 6. Besides, the attachment end 18 of the membrane body 16 is releasably connected to the enclosure 6 via a quick release coupling in the form of a snap coupling 66 consisting of two cooperating elements, comprising a first coupling element 66*a* and a second coupling element 66*b*. In this example, the enclosure 6 is provided with an internal collar 68 defining said drinking opening 10. The internal collar 68 is provided with said first coupling element 66*a*, whereas the attachment end 18 is provided with said second coupling element 66*b*.

FIGS. 1*b*, 2*b*, 3*b* and 3*c* show the valve 2 in an active and open position, in which the valve seat 24 has been moved away from the stationary valve head 22 due to the fact that an underpressure P2 has been supplied and is present in the suction chamber 30. Thereby, a resulting pressure difference (P1-P2) will also be present in the suction chamber 30. This pressure difference activates, deforms and thus moves the membrane body 16 with a valve-opening force due to the membrane body 16 changing its three-dimensional, radial shape and becomes shorter axially. The membrane body 16 shown in all of the figures is deformed radially inwards. Deformation of the membrane body 16 shown in FIGS. 1*b* and 2*b*, however, causes the membrane body 16 to be shortened axially, whereas the membrane body 16 shown in FIGS. 3*b* and 3*c* is extended axially.

In FIG. 3*c*, the valve 2 is also shown in a venting position, in which the pressure in the drinking receptacle 4 is less than the ambient pressure P1 due to outflow of liquid. In this condition, a pressure difference (P1-P3) acts on said flexible sealing collar 64 and moves it inwards in the direction of the drinking receptacle 4 until it opens to venting via said vent 46 in the enclosure 6, the pressure balancing chamber 26 and a slot 70 between the sealing collar 64 and the shoulder 48 of the enclosure 6. The direction of air admission is shown with downstream-directed arrows in the figure. The sealing collar 64 will re-seal as soon as a pressure equalisation is present in the drinking receptacle 4, i.e. when P3 is larger or equal to P1. Venting of the drinking receptacle 4 is not restricted to be carried out only when the valve is activated and open, venting may also be carried out independently of this method of venting.

Upon cessation of the underpressure P2, the valve 2 will close in response to elastically resilient rebound after deformation of the flexible membrane body 16, said sealing collar 56, 64, said ring gasket 58 and/or said flexible sleeve 62.

Figure 4A:
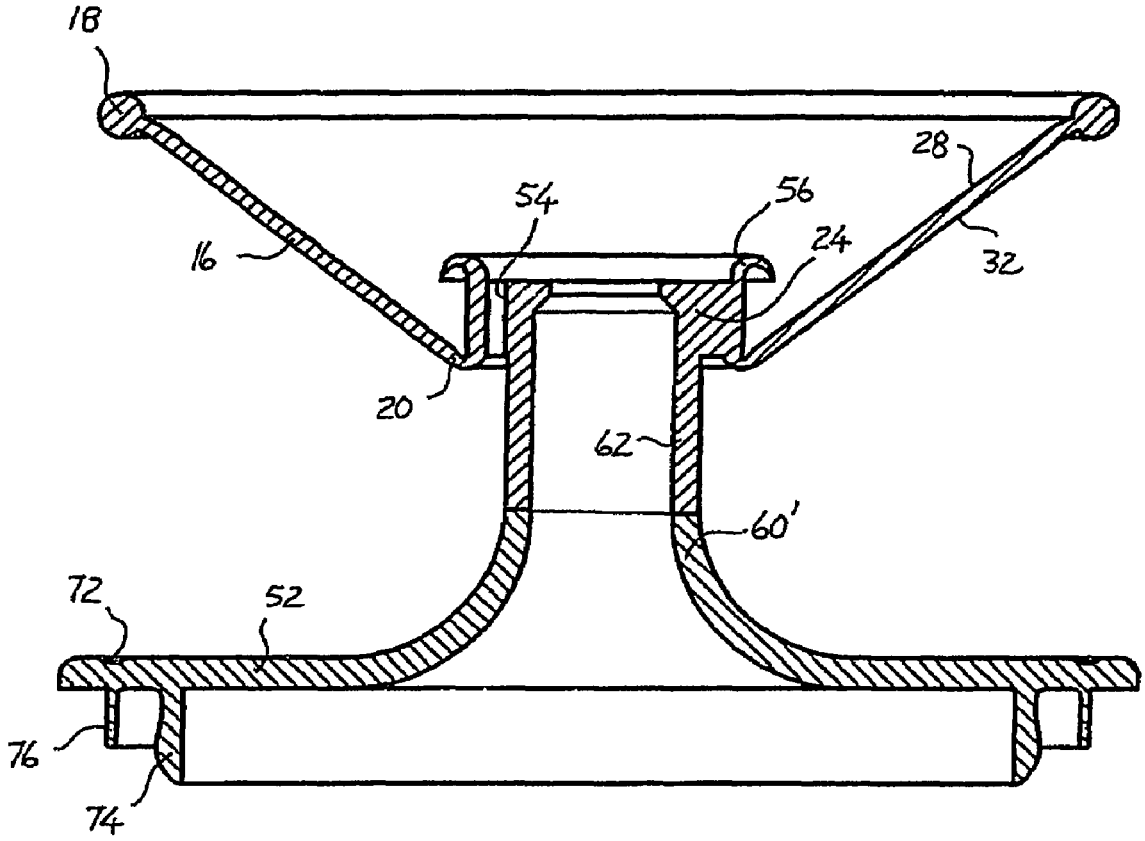
Figure 4B:
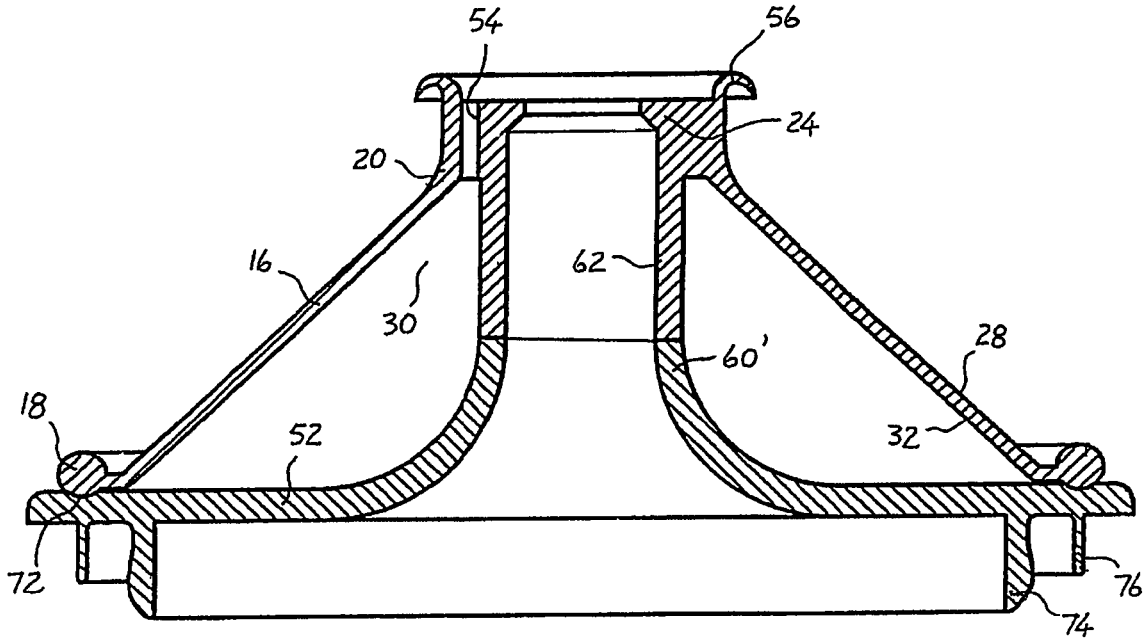
Figure 4C:
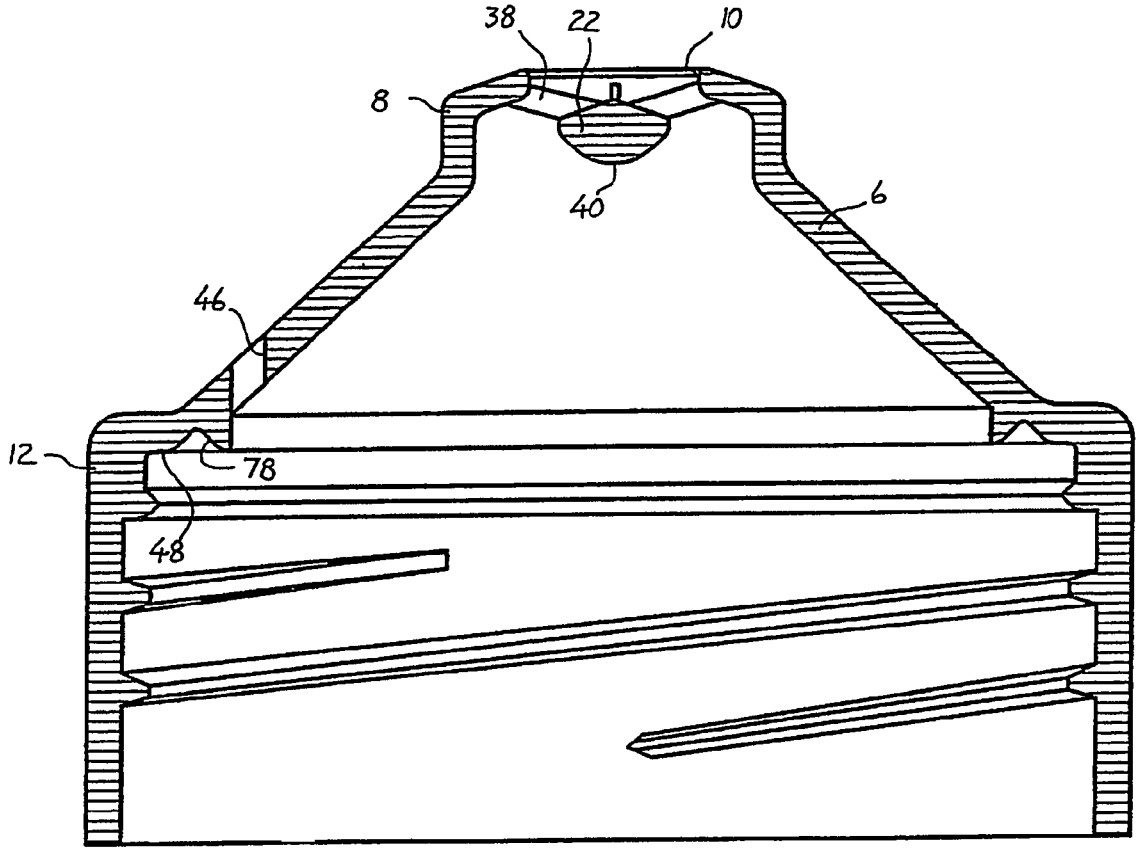
Figure 4D:
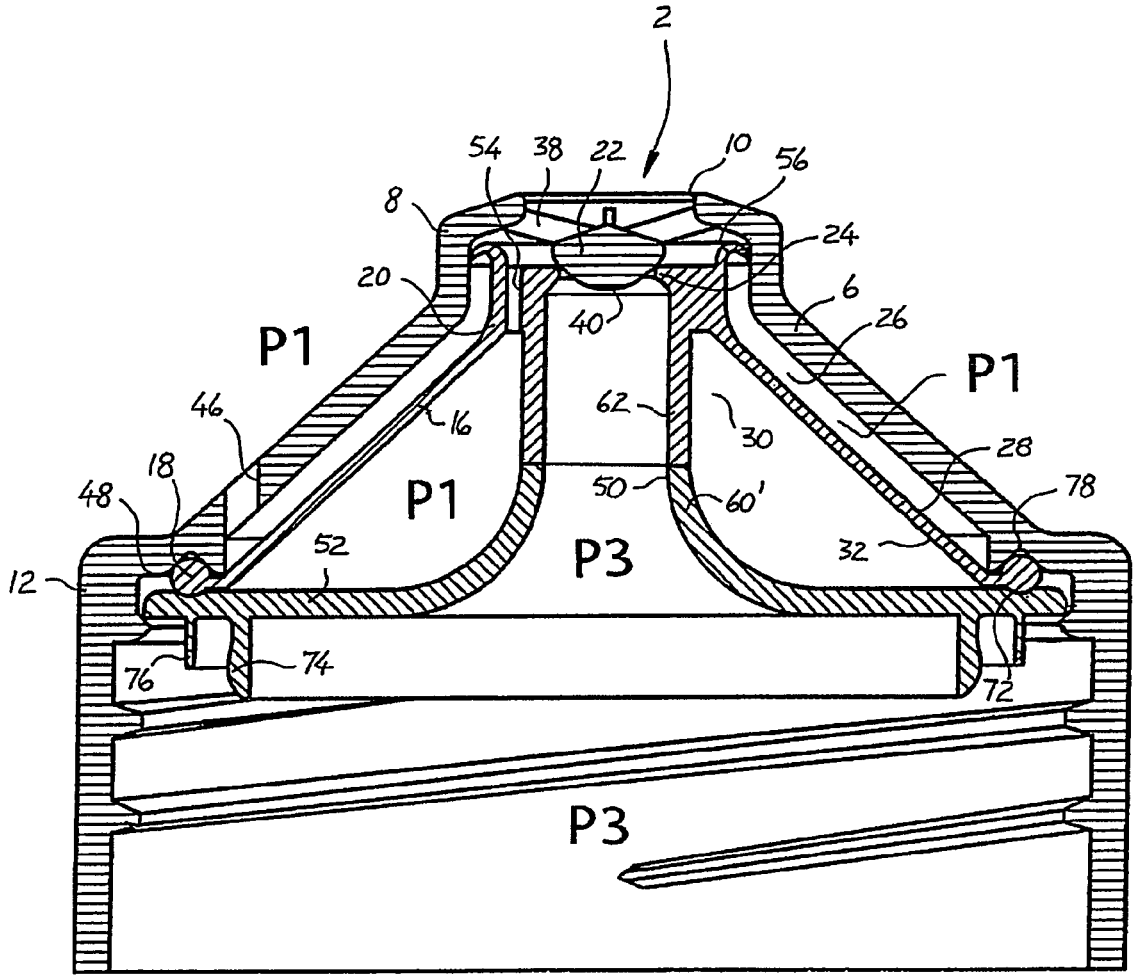
FIG. 4*d* shows the components after their assembly.

According to another aspect of the invention, FIGS. 4*a*-4*d* show a fourth embodiment of the present valve device resembling the embodiment shown in FIGS. 2*a*-2*b*. FIGS. 4*a*-4*c* show individual components of the valve device prior to their assembly, whereas FIG. 4*d* shows these components after their assembly.

More particularly, FIG. 4*a* shows the membrane body 16 having an advantageous shape for mass-producing by means of common moulding techniques. By forming a casting mould so as to provide a corresponding membrane body 16 having a spread-out Y-shape when produced in the mould, the membrane body 16 will be easy to remove from the mould without inflicting any damage thereto in doing so. As such, the membrane body 16 has a spread-out Y-shape when moulded and removed from the corresponding casting mould. In this embodiment, however, the attachment end 18 of the membrane body 16 is formed as an O-ring having a circular cross section. Furthermore, said sleeve 62 attached to the partition 52 is integrated with the valve seat 24.

Moreover, FIG. 4*b* shows the membrane body 16 after being deflected and folded down into its normal shape of use, in which the O-ring 18 engages a corresponding first circular groove 72 provided on the downstream side of said partition 52. In this embodiment, the upstream side of the partition 52 is also provided with a bulbous collar 74 and a surrounding support collar 76, between which a bottle 4 (not shown) may be lodged for attachment to the present valve device.

Yet further, FIG. 4*c* shows a screw cap 6 resembling that of FIGS. 1*a*-2*b*. In this embodiment, the shoulder 48 of the screw cap 6 is provided with a second circular groove 78 for engaging said O-ring 18.

FIG. 4*d* shows the present valve device assembled within the screw cap 6 and ready to be connected to the bottle 4, in which position the O-ring 18 is lodged between said first and second grooves 72, 78.

The invention claimed is:

1. A device of a valve for a drinking receptacle having an internal pressure, in which the valve is provided in an enclosure, a downstream end thereof being provided with a drinking opening, and an upstream end thereof being open and attached around an opening in the drinking receptacle when in position of use, whereby the valve may open and close to liquid outflow from the drinking receptacle via said drinking opening, which is provided downstream of the valve; in which the valve comprises:

a flexible membrane body provided with an attachment end fixedly connected to the enclosure when in position of use, and a free manoeuvre end pressure-sealingly and movably connected to the enclosure;

a valve head; and a valve seat against which the valve head seals when the valve is inactive and in its position of rest;

in which the enclosure also contains:

a pressure balancing chamber communicating with an ambient pressure of the enclosure and one side of the membrane body; and a suction chamber communicating with said downstream drinking opening and the other side of the membrane body;

in which the valve is arranged to open to said liquid outflow when the suction chamber, via said downstream drinking opening, is supplied an underpressure which is less than said ambient pressure by a predetermined value, whereby the membrane body is exposed to a pressure difference that activates and moves the membrane body with a valve-opening force, characterized in that the valve head is fixedly and by-passably connected to the enclosure;

wherein the valve seat is connected to the manoeuvre end of the membrane body;

wherein the valve seat is provided upstream of the valve head; and wherein the valve seat is pressure-sealingly and movably connected to the enclosure;

whereby the valve seat may be moved away from the valve head and open the valve to liquid outflow when the suction chamber is supplied said underpressure.

2. The device according to claim 1, characterized in that the membrane body has an axial extension and thus forms a sleeve-like body.

3. The device according to claim 2, characterized in that the sleeve-like body has a tubular, conical or approximately conical shape.

4. The device according to claim 1 characterized in that the attachment end of the membrane body is connected to the enclosure at or near the upstream end thereof, whereas the manoeuvre end of the membrane body is connected to the enclosure at or near the downstream end thereof.

5. The device according to claim 4, characterized in that the upstream side of the valve seat is flexibly connected to an outflow opening in a partition provided between the attachment end and the opening in the drinking receptacle, whereby said suction chamber is provided between the partition and the membrane body, whereas said pressure balancing chamber is provided between the membrane body and the enclosure; and wherein the valve seat is provided with at least one connection channel connecting the suction chamber with the drinking opening.

6. The device according to claim 5, characterized in that the upstream side of the valve seat is provided with a flexible ring gasket arranged so as to engage pressure-sealingly around said outflow opening in the partition.

7. The device according to claim 6, characterized in that the outflow opening is provided in a free end of a tubular outflow channel, which projects out from the partition and forms a part thereof.

8. The device according to claim 5, characterized in that the upstream side of the valve seat is provided with a flexible sleeve, which is connected to said outflow opening in the partition.

9. The device according to claim 8, characterized in that the upstream end of the sleeve is connected to a tubular outflow channel, which projects out from the partition and forms a part thereof.

10. The device according to claim 1, characterized in that the valve seat is pressure-sealingly and movably connected to the enclosure via a flexible sealing collar provided on the outside of the valve seat.

11. The device according to claim 4, characterized in that the membrane body has a spread-out Y-shape when moulded and removed from a corresponding casting mould.

12. The device according to claim 1, characterized in that the attachment end of the membrane body is connected to the enclosure at or near the downstream end thereof, whereas the manoeuvre end of the membrane body is connected to the enclosure at or near the upstream end thereof.

13. The device according to claim 12, characterized in that the upstream side of the valve seat is pressure-sealingly and movably connected to the enclosure via a flexible sealing collar provided on the outside of the valve seat and projecting out therefrom;

said pressure balancing chamber thus being provided between the sealing collar, the membrane body and the enclosure, whereas the suction chamber is provided between the membrane body and said drinking opening in the enclosure.

14. The device according to claim 13, characterized in that the flexible sealing collar is connected to a sealing surface in the form of an internal shoulder in the enclosure.

15. The device according to claim 12, characterized in that the attachment end of the membrane body is releasably connected to the enclosure.

16. The device according to claim 15, characterized in that the attachment end and the enclosure are connected via a quick release coupling.

17. The device according to claim 16, characterized in that the quick release coupling is a snap coupling or a threaded connection.

18. The device according to claim 16, characterized in that the enclosure is provided with an internal collar defining said drinking opening; and wherein the internal collar is provided with a first coupling element of the quick release coupling, whereas said attachment end is provided with a cooperating second coupling element of the quick release coupling.

19. The device according to claim 1, characterized in that the enclosure is provided with at least one vent into said pressure balancing chamber.

20. The device according to claim 1, characterized in that the valve head is connected to the enclosure via at least one stay.

21. The device according to claim 1, characterized in that at least one of the valve head and the valve seat is/are provided with, or is/are arranged as, a guiding device that centres the valve head in the valve seat during closing of the valve.

* * * * *

UNITED STATES PATENT AND TRADEMARK OFFICE

CERTIFICATE OF CORRECTION

PATENT NO. : 7,419,069 B2
APPLICATION NO. : 10/572111
DATED : September 2, 2008
INVENTOR(S) : Kjetil Naesje It is certified that error appears in the above-identified patent and that said Letters Patent is hereby corrected as shown below:

Title page, item (30) Foreign Application Priority Data

Sep. 16, 2003 (NO) ..... Delete "200334132" and replace with --20034132--

Signed and Sealed this

Twenty-first Day of April, 2009

JOHN DOLL
*Acting Director of the United States Patent and Trademark Office*